United States Patent [19]

Nieminen et al.

[11] Patent Number: 4,997,524

[45] Date of Patent: Mar. 5, 1991

[54] METHOD AND APPARATUS FOR TRANSPORT OF A WEB TO BE THREADED

[75] Inventors: Matti Nieminen; Pentti Alatalo, both of Karhula, Finland

[73] Assignee: Valmet-Ahlstrom Inc., Karhula, Finland

[21] Appl. No.: 392,903

[22] Filed: Aug. 14, 1989

[30] Foreign Application Priority Data

Aug. 25, 1988 [FI] Finland ..... 883923

[51] Int. Cl.[5] ..... D21F 7/00; D21F 1/42

[52] U.S. Cl. ..... 162/193; 83/98; 83/99; 162/194; 162/286

[58] Field of Search ..... 162/193, 194, 255, 286; 34/120; 83/98, 99, 24

[56] References Cited

U.S. PATENT DOCUMENTS

| | | | |
|---|---|---|---|
| 1,687,847 | 10/1928 | Read | 162/193 |
| 3,355,349 | 11/1967 | Devlin | 162/193 |
| 4,014,487 | 3/1977 | Reba et al. | 226/5 |
| 4,132,371 | 1/1979 | Byrt | 242/58.3 |
| 4,172,007 | 10/1979 | Kankaanpää162 | 206/ |
| 4,186,860 | 2/1980 | Reba | 226/91 |
| 4,429,819 | 2/1984 | Palovaara | 226/95 |
| 4,501,643 | 2/1985 | Kiuru | 162/193 |
| 4,513,517 | 4/1985 | Vedenpää34 | 114/ |
| 4,543,160 | 9/1985 | Kerttula et al. | 162/193 |
| 4,566,944 | 1/1986 | Mauranen et al. | 162/286 |
| 4,610,097 | 9/1986 | Kotitschke | 34/117 |
| 4,648,942 | 3/1987 | Wanke | 162/286 |
| 4,726,502 | 2/1988 | Cryderman | 162/193 |
| 4,818,343 | 4/1989 | Laine | 162/193 |

*Primary Examiner*—Karen M. Hastings

*Attorney, Agent, or Firm*—Nixon & Vanderhye

[57] ABSTRACT

The invention relates to a method and an apparatus for cutting off and guiding a strip cut from the edge of a paper web in a threading operation. The strip is released from a cylinder by blowing and is guided by pocket blowing so as to form a bag and is then cut off. The strip is conducted through an arrangement functioning as a draw-press, which pulls the strip against a cutting member of a cutting device in such a way that it is severed and the strip can immediately be transferred further.

9 Claims, 3 Drawing Sheets

METHOD AND APPARATUS FOR TRANSPORT OF A WEB TO BE THREADED

The invention relates to a method for cutting off and guiding a strip cut from the edge of a paper web in a threading operation in a paper machine, in which method the strip is released from the last cylinder of the machine by blowing by pressurized gas, e.g., air, and is guided by so-called 'pocket blowing' so as to form a 'bag', and which strip is then cut off.

The invention also relates to an apparatus for cutting off and guiding a strip cut from the edge of a paper web, which apparatus comprises jet pipes connected to a compressed air source, nozzles fitted to the pipes, and guiding plates for guiding the strip, and which apparatus includes means for releasing the strip from the cylinder, means for conducting the strip into a gap, and web-cutting means.

It is an object of the present invention to provide an apparatus for use at such points of a paper machine where the threading of the web is done by cutting a narrow strip (150 to 200 mm) from the edge of the full-width web, which strip is conducted further by means of compressed air jets. Such points are, for example, where the web is transferred from the last drying cylinder to the machine stack or from the lower roll of the calender onto the winding machine.

Previously, the problem at these points has been the strips already on their way to the waste processing machine, the so-called 'pulper', sticking to and following with the strip cut in the way described above, which is allowed to slide down towards the pulper before being led away from the pulper and further, for instance, into the first gap of the calender or into the nip between the pope-type cylinder and the reel spool by means of compressed air jets, this strip greatly hindering the threading process by its weight. Another drawback is that the paper comes to the next nip 'rolling' doubled over the folding point, whereby the progress slows down substantially, thereby impeding the threading of the strip between the rolls.

The extra 'tail' also has a tendency of sticking to various parts of the machine, whereby the threading process has to be stopped in most cases.

According to prior art, attempts to prevent the above drawbacks have been made by providing various mechanical conveyors for transferring the edge strip, e.g., from the drying cylinder to the calender. These known solutions can be very costly compared to the transfer by air-jets, and, in any case, the doubling of the paper strip at the next nip cannot be prevented.

The problem with the transfer of the strip is its 'tail', which, after being cut off, falls down into the basement below the machine. It has not been possible to arrange the cutting of the strip in a satisfactory way.

According to prior art, air-blowing and a toothed blade have been used for the cutting operation. This solution functions when the mess of the web is under 120 g/m$^2$.

It is an object of the invention to provide a method and apparatus for transport of an edge strip to be threaded wherein there is no long end-tail of the strip after the cutting-off.

It is particularly an object of the invention to provide a method and apparatus which functions well for heavier webs also, and where the above drawbacks do not occur. The method according to the invention for achieving the above mentioned objects is mainly characterized in that the strip, after being cut off, is conducted through an arrangement functioning as a draw-press, which pulls the strip against a cutting member of a cutting device in such a way that it is severed, whereby the strip can immediately be transferred further.

The apparatus according to the invention is mainly characterized in that the apparatus also comprises a draw-press, which pulls the strip against a cutting member of a cutting device in such a way that the strip can immediately be transferred further.

Preferred embodiments of the invention have the characteristic features according to the subclaims whose subject matter is incorporated herein by reference.

In the invention, a blowing plate and the release of the web by blowing are still used as previously but with the additions mentioned above, and prior art 'pocket-blowing' can be used to conduct the web into a gap.

The invention is described below in detail with reference to the figures of the attached drawings, to which the invention is, however, not limited.

BRIEF DESCRIPTION OF THE DRAWINGS

FIG. 1 illustrates the last drying cylinder 10 of a multi-cylinder dryer in a paper machine belonging to the upper row of drying cylinders. A doctor blade 11 is disposed in proximity to the lower periphery of the drying cylinder 10.

Figure 1:
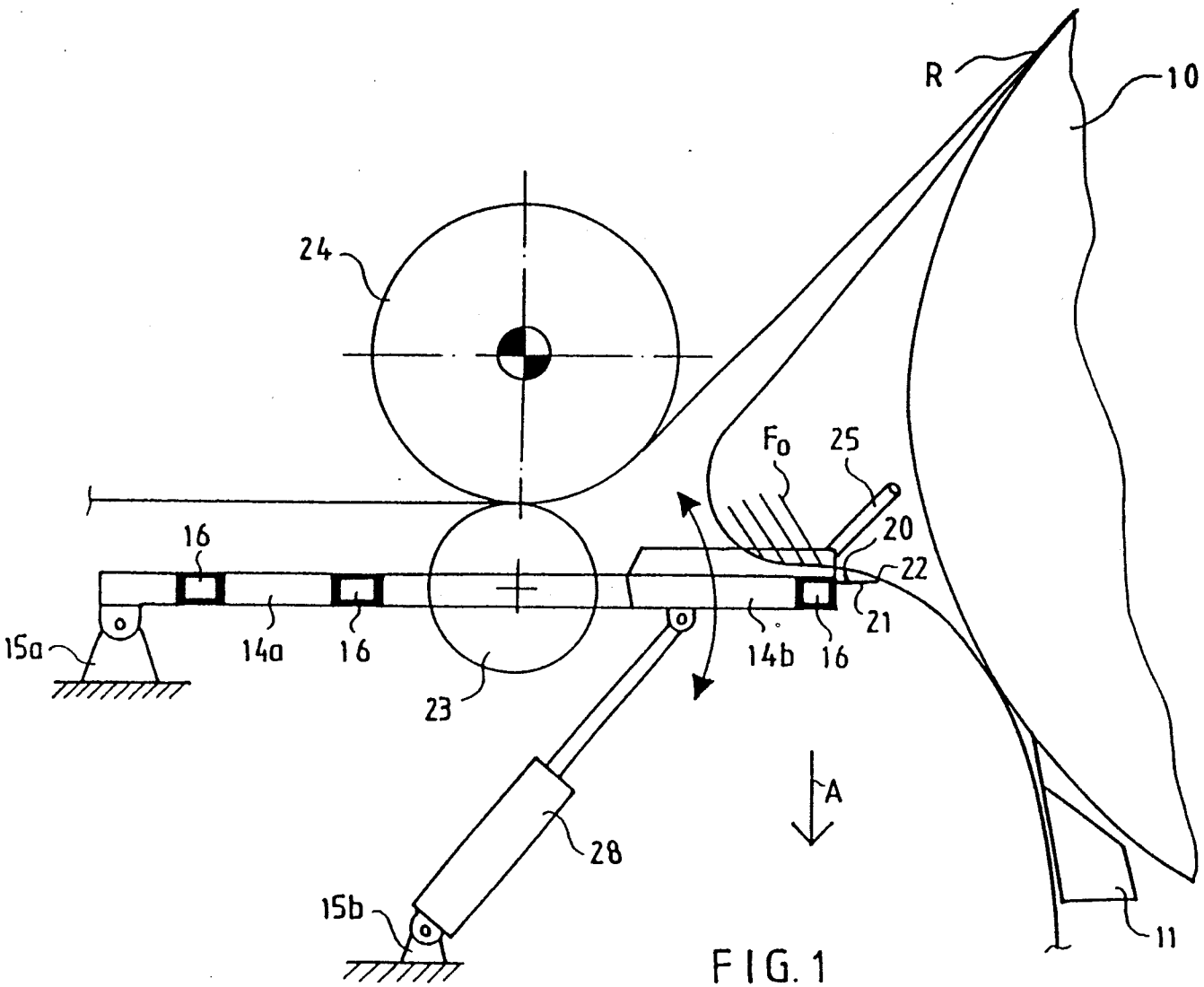
FIG. 1 is a schematic side view of an apparatus according to the invention disposed in connection with the last cylinder of a paper machine.

Before using the apparatus according to the invention, the threading strip R and the part of the web from which the strip has been cut are conducted towards the pulper, this direction being designated by arrow A in FIG. 1. The threading strip R, which is cut from the edge of the web, is to be conducted, for instance, into the first nip of a calender. This is partly achieved by using the guiding and cutting means of the threading strip according to the invention which is explained below in more detail.

The device according to the invention for guiding and cutting off the threading strip R shown in FIG. 1 comprises guiding plate elements 14*a*, 14*b*, which are supported by the frame structure at point 15*a*, 15*b*. The guiding plate element 14 includes rows of nozzles 16, which blow in the length direction of element 14. A device 20 for cutting and guiding the threading strip R is attached to the guiding plate element 14. The device 20 includes a first guiding plate 21, which is immediately followed by the guiding plate element 14. The device 20 further includes a cutting member 22, preferably a sharp saw blade 22, by means of which the strip R is cut off.

Figure 2:
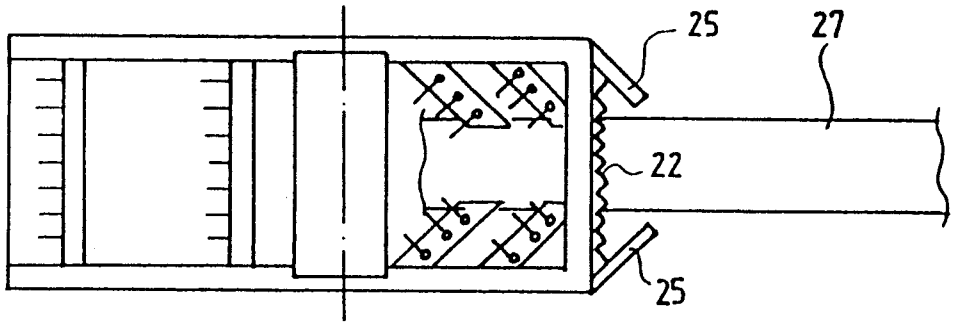
FIG. 2 is a plan view of the cutting device included in the apparatus of FIG. 1.

The function of the apparatus of FIGS. 1 and 2 is now described. The rows of nozzles 16 blowing in the length direction of the guiding plate element 14 are connected to a compressed-air line. By 'pocket blowing' $F_o$ the strip R is brought close to guiding plate 14.

According to the invention, a roll 23 is disposed in connection with the guiding plate element 14, which is preferably coated with rubber or some other similar material. The roll 23 forms a nip with a driven paper leading roll 24 located above it, in such a way that it is pressed against the leading roll by means of an air cylinder. Further, release blowing means 25 are attached to both sides of the guiding plate 14, by means of which the strip is released from the cylinder 10.

When the strip R is released from the cylinder 10, it is conducted through a nip functioning as a draw-press according to the invention. This draw-press arrangement pulls the strip against the blade 22 of the cutting device 20 in such a way that the strip is cut off.

Figure 3:
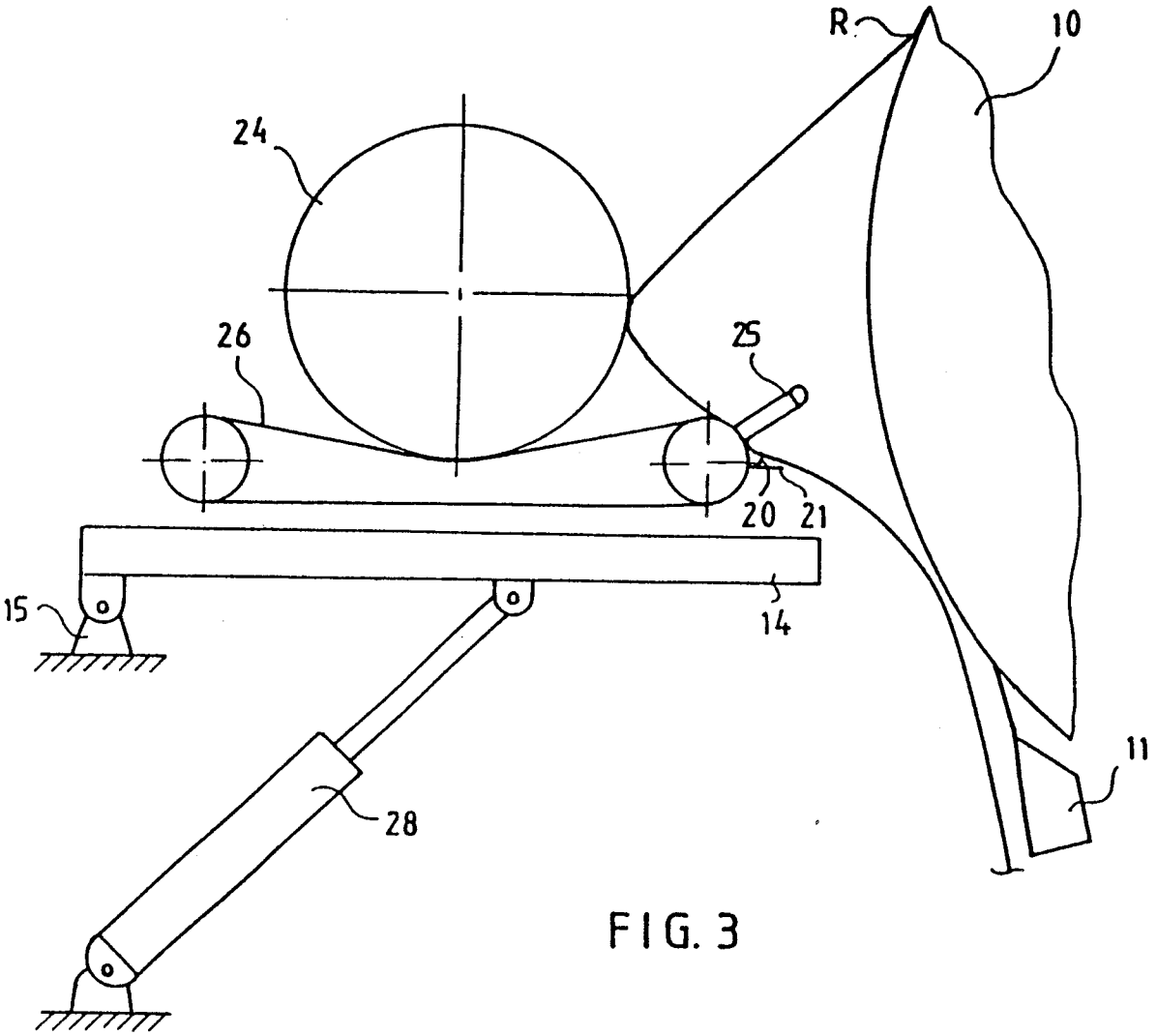
FIG. 3 is a schematic elevation of another embodiment of the invention.

The apparatus shown in FIG. 3 comprises guiding plate element 14 to which a cutting device 20 with blade 22 is attached, as described above. In this embodiment, a conveyor, preferably a belt conveyor, along with the paper leading roll forms a nip and functions as a draw-press. The apparatus according to FIG. 3 has the same operating principle as that of FIG. 1, i.e., the strip R is released by means of release blowers 25 and conducted by pocket blowing and guiding plate 14 into the nip which pulls the strip against the blade 22 of the cutting device 20 in such a way that the strip is cut off.

By using solutions according to FIGS. 1 and 3, the strip is cut and conducted further without forming a detrimental 'tail' which would fall in the basement below the machine.

FIG. 2 is a plan view of the cutting device 20. The figure shows a threading strip R, which is usually 150–200 mm wide, release blowers 25, the blade 22 of the cutting device and the pocket blowing pipes, by means of which a bag is formed and blown into the nip.

The device shown in FIGS. 1 and 3 functions also as a pick-up means apart from functioning as a cutting and guiding device. The device comprises a guiding plate element 14 described above. The device is pivotable about a horizontal Cardan shaft by means of a hydraulic or pneumatic cylinder 28 or some similar actuator.

In the following the patent claims are presented, which define the inventional concept within the scope of which the details of the invention may vary.

We claim:

1. A method for guiding and cutting off a strip separated from the side edge of a paper web for a threading operation, using: guiding plates; a cylinder; a release means with a first roll attached thereto; a draw press including a driven leading roll located above and pressed into engagement with the first roll; and a cutting member of a cutting device, comprising the steps of:

releasing the strip from the cylinder by blowing with the release means;

guiding the strip along the guiding plates by pocket blowing so as to form a bag;

conducting the strip through the draw-press and simultaneously engaging the strip with the first roll and the leading roll; and severing the strip by having the draw-press pull the strip against the cutting member of the cutting device so that the strip can be immediately transferred further.

2. An apparatus for guiding and cutting off a strip separated from a side edge of a paper web, which apparatus comprises:

guiding plates for guiding the strip;

means for releasing the strip from a cylinder;

pocket blowing means for conducting the strip close to the guiding plates;

ducting means connected to a compressed air source for supplying air to said releasing means;

strip-cutting means including a cutting member of a cutting device;

a draw-press means, which pulls the strip against said cutting member of said cutting device in such a way that the strip is severed and can immediately be transferred further, said draw press means comprising a roll attached to said release means; and a driven leading roll located above said roll; and wherein said roll is in contact with said driven leading roll.

3. The apparatus according to claim 2, wherein said roll is coated with rubber or similar material.

4. Apparatus for guiding and cutting off a strip separated from a side edge of a paper web, comprising:

a cylinder about which said strip extends;

a doctor blade operatively associated with the cylinder;

guiding plate means for guiding the strip, comprising at least one guide plate;

release blowing means distinct from the doctor blade, for providing a flow of air which releases the guiding strip from the cylinder;

pocket blowing means for conducting the strip close to said at least one guide plate;

strip cutting means including a cutting member of a cutting device; and draw-press means for pulling the strip against said cutting member of said cutting device so that the strip is severed and is immediately transferred further thereby.

5. Apparatus as recited in claim 4 wherein said release blowing means is mounted to said at least one guide plate.

6. Apparatus as recited in claim 5 further comprising means for mounting said at least one guide plate for pivotal movement about an axis, and power means for powering the movement of said at least one guide plate about said axis.

7. Apparatus as recited in claim 6 wherein said power means comprise a pneumatic or hydraulic cylinder.

8. Apparatus as recited in claim 4 wherein said release blowing means are mounted in operative association with a roller associated with a conveyor belt.

9. Apparatus as recited in claim 5 wherein said pocket blowing means are mounted on said at least one guide plate.

* * * * *